United States Patent [19]

Anderson

[11] Patent Number: 4,955,640

[45] Date of Patent: Sep. 11, 1990

[54] Z-FOLDED PACKING LIST/INVOICE

[75] Inventor: Michael W. Anderson, Erie, N.Y.

[73] Assignee: Moore Business Forms, Inc., Grand Island, N.Y.

[21] Appl. No.: 398,642

[22] Filed: Aug. 25, 1989

[51] Int. Cl.[5] ..... B42D 1/00

[52] U.S. Cl. ..... 281/2; 281/5; 283/81; 283/101; 283/103; 283/105; 283/106

[58] Field of Search ..... 283/56, 81, 98, 100, 283/101, 103, 105, 106, 84; 282/16 A, 16 B, 16 C; 281/2, 9, 5; 40/306, 315; 229/16 A, 92.7, 73, 74

[56] References Cited

U.S. PATENT DOCUMENTS

| | | | |
|---|---|---|---|
| 2,706,865 | 4/1955 | Miller . | |
| 4,323,608 | 4/1982 | Denny et al. . | |
| 4,543,082 | 9/1985 | Stenner | 229/73 |
| 4,592,572 | 6/1986 | Instance . | |
| 4,621,837 | 11/1986 | Mack | 283/81 |
| 4,688,826 | 8/1987 | Hosoya | 40/306 |
| 4,711,686 | 12/1987 | Instance | 281/2 |
| 4,744,591 | 5/1988 | Instance | 281/5 |
| 4,747,618 | 5/1988 | Instance | 281/5 |
| 4,754,915 | 7/1988 | Steidinger | 229/73 |

*Primary Examiner*—Paul A. Bell
*Assistant Examiner*—Hwei-Siu Payer
*Attorney, Agent, or Firm*—Nixon & Vanderhye

[57] ABSTRACT

A business form suitable for use as a packing list or invoice attached to the package, and having the portion which serves as a shipping label to which variable address information may be applied, is produced in a simple and effective manner. Label stock and a bond paper portion are glued together at an overlapping section. Tractor holes may be provided in the free edges of the label and bond portions to facilitate driving through a printer. An adhesive strip on a first face of the label stock and another adhesive strip on a second, opposite face of the bond portion, holds the sections of the form together when it is Z-folded (accordion folded). The release liner on the label stock is removed to apply the form onto a package. The first face of the form may be printed utilizing a non-impact printer, with variable information. The second face of the form may be printed with non-variable information at a manufacturing location.

14 Claims, 4 Drawing Sheets

Z-FOLDED PACKING LIST/INVOICE

BACKGROUND AND SUMMARY OF THE INVENTION

Under many circumstances, it is desirable for a business forms manufacturer to provide forms that can be imprinted with variable information by the customer of the manufacturer. Customers often have non-impact printers, such as cold fuse printers, laser printers, LED printers, or the like, and thus it is desirable to design the form so that the variable information may be readily applied with such non-impact printers (although this information obviously can also additionally be applied with an impact printer). This general experience is particularly appropriate for the situation in which the form is to be used as a packing list/invoice which is designed to be applied to the outside of the package.

According to the present invention, a business form, a method of producing a business form, and a package in combination with a packing list and invoice, are provided which facilitate the placement of variable information on a business form by the customer. This is accomplished by attaching bond stock to label stock in an overlapping edge portion thereof. Adhesive is applied at particular portions of the bond and label stock so as to allow the form to be Z-folded or accordion folded into a packing list/invoice configuration, and tractor holes are provided at edges thereof to facilitate passage through printers.

According to one aspect of the present invention, a business form suitable for use as a packing list or invoice attached to a package is provided. The business form comprises: a label stock portion having first and second side edges and first and second major faces, a bond paper portion having first and second side edges and first and second major faces, the second edge of said label stock portion being overlapped with the second edge of the bond paper portion and fixed together at the overlapped portion, means defining tractor holes adjacent said label stock portion first edge and adjacent said bond stock portion first edge, for facilitating feeding of said form through printers, and said second face of said label stock essentially completely covered by adhesive.

According to another aspect of the present invention, a business form serves as a packing list for an invoice comprises the following elements: a label stock portion having first and second side edges and first and second major faces, a bond paper portion having first and second side edges and first and second major faces, the second edge of said label stock portion being overlapped with the second edge of the bond paper portion and fixed together at the overlapped portion, an adhesive strip applied to said first face of said label stock adjacent said first edge, said second face of said label stock essentially completely covered by adhesive, and an adhesive strip applied to said bond portion second face adjacent said first edge thereof.

According to the invention there also is provided a method of producing a business form. A method comprises the steps of (a) at a first location, forming a continuous business forms from label stock and bond paper overlapping the bond and label stock portions first and second ends, respectively, to provide a continuous form, (b) printing the second face of the bond portion of the form, (c) at a second location, remote from the first location, printing the first face of the bond portion and the label portion, including printing address information on a section of the bond portion, (d) Z-folding the bond portion over the label portion and attaching the portions together in a Z-folded position, and (e) removing the release liner from the label stock and affixing the first face of the label stock to a package, with the address information section of the bond stock visible from the exterior of the package. Step (c) is preferably practiced by non-impact printing variable information on the forms.

A packing list/invoice according to the invention is utilized in association with a package. This combination comprises a first section having a first face with adhesive thereon connecting said first section to said package, and a second face with invoice information thereon, a second section overlying said first section, a third section overlying said second section, said third section having address information on the face thereof opposite said package, said first, second and third sections having opposite generally aligned first and second edges, removable means for removably operatively connecting said first, second, and third sections together along the first edge thereof, and said first, second, and third sections also being operatively connected together at or adjacent the second edge thereof, opposite the first edge.

It is the primary object of the present invention to provide a simple and effective business form construction utilizable as a packing list and invoice and that it utilizable in such a manner as to allow variable information to be applied by the manufacturer's customer including using a non-impact printer. This and another objects of the invention will become clear from an inspection of the detailed description of the invention and from the appended claims.

DETAILED DESCRIPTION OF THE DRAWINGS

Figure 1:
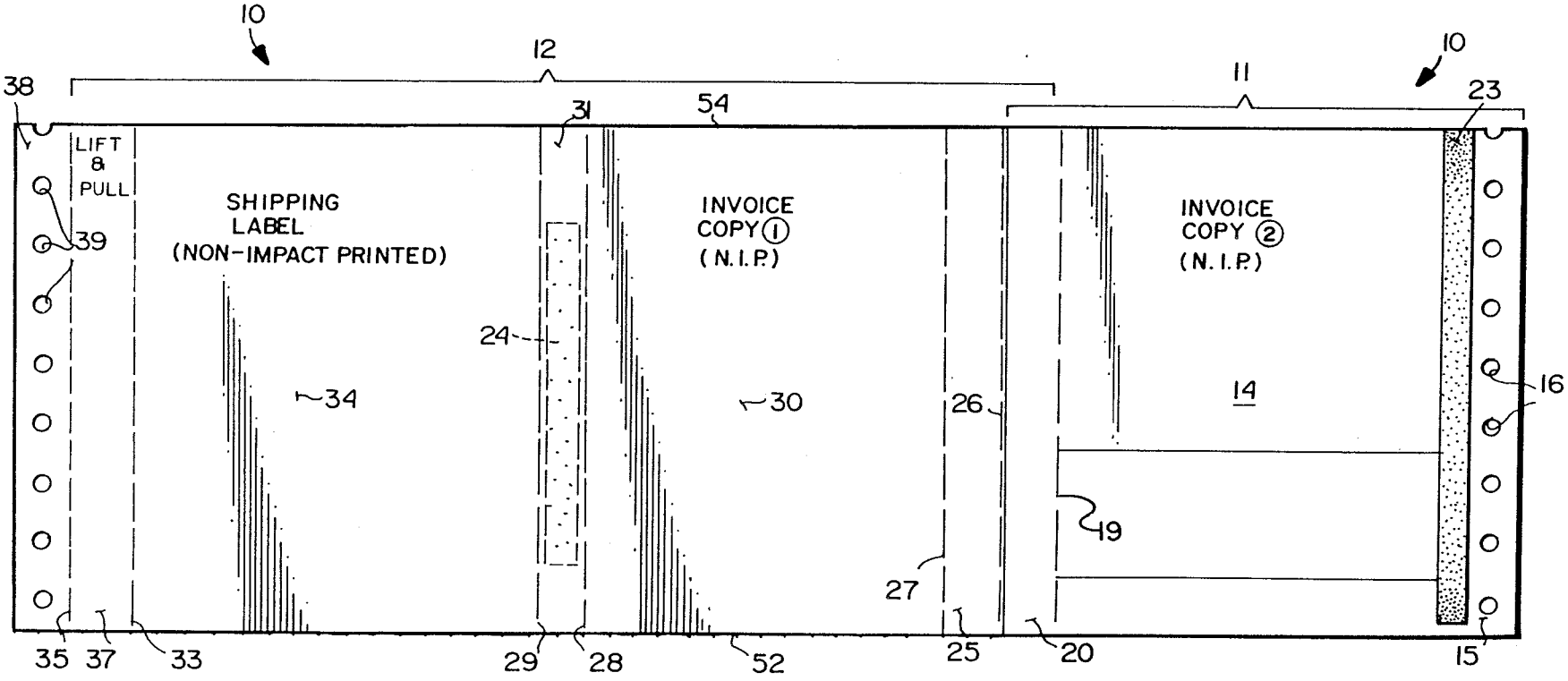
FIG. 1 is a a top plan view of a business form according to the invention prior to use thereof.
Figure 2:
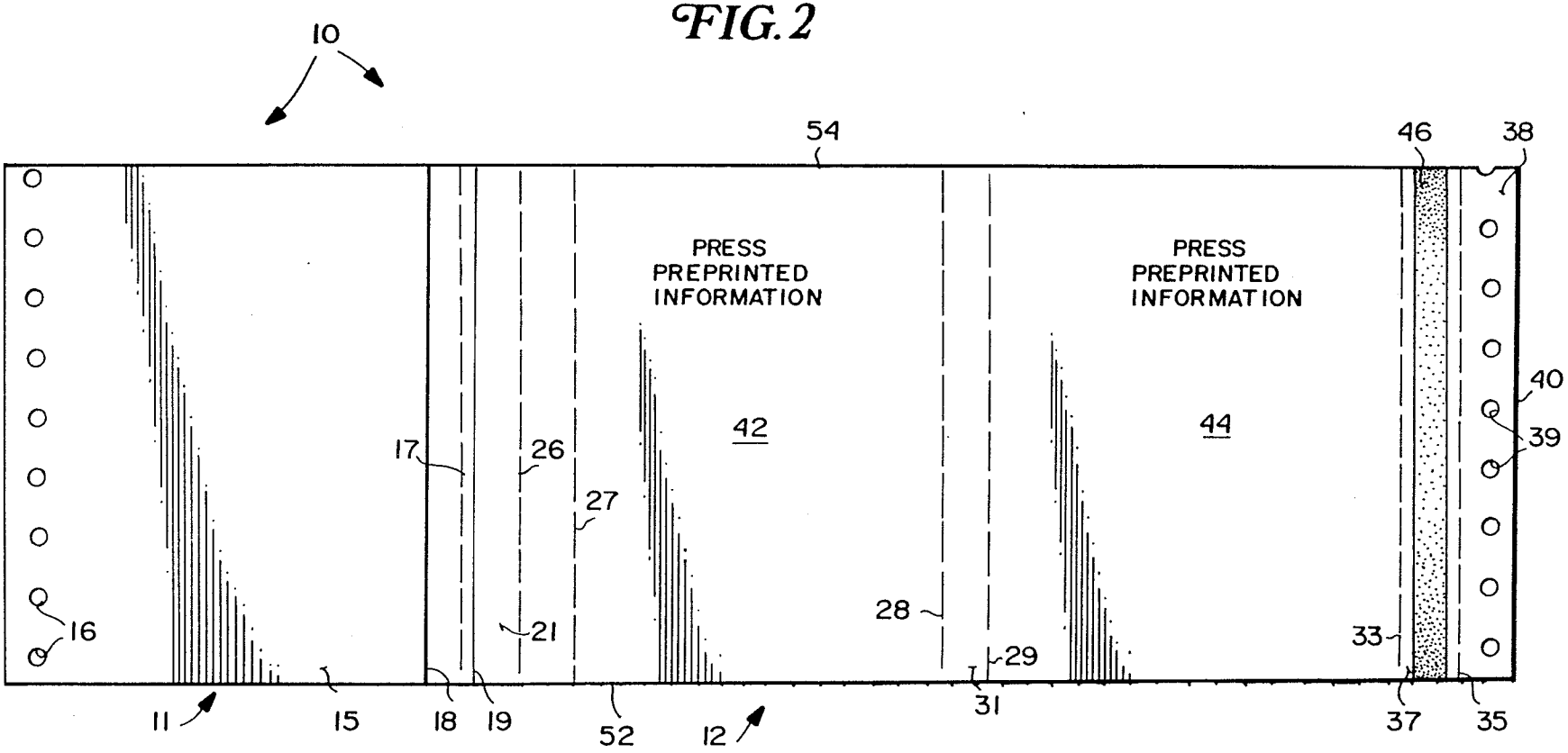
FIG. 2 is a bottom plan view of the business form of FIG. 1.

A business form according to the invention, detached from a continuous sheet of forms, as shown generally by reference numeral 10 in FIGS. 1 and 2. The form includes a label stock portion 11, and a bond paper portion 12. The label stock has a first major face 14 which comprises adhesive backed paper with release paper (release liner) 15 covering the adhesive on the adhesive backed paper. The adhesive side of the label stock is the second major face **14*a* edge of the label stock means defining tractor holes 16 are provided for facilitating feeding of the form 10** through printers.

The bond paper portion 12 has an edge 19 thereof that overlaps the label stock 11 and terminates just short of the edge 18 of the release paper covering the second major face 14a of the label stock the bond paper portion having first and second major faces parallel to and overlying the label stock first and second major faces. Perforation 17 is provided between the edges 18, 19. This way an overlapping area having faces 20 (FIG. 1) and 21 (FIG. 2) is provided. Tractor holes (not shown) may optionally be provided in alignment in this overlapping area 20, 21. The overlapping portions 20, 21 may be secured together in any effective manner, such as by using a conventional adhesive.

Adjacent the tractor holes 16 of the label stock 11 is an adhesive strip 23. The adhesive is preferably a hot melt reheatable or pressure seal adhesive, although other types may be utilized. Alternatively an adhesive strip 24 (FIG. 1) could be utilized. The adhesive strip 23 (or 24) is for holding the form together once it has been Z-folded.

The construction of the preferred form illustrated in FIGS. 1 and 2 also preferably comprises a perf line 26 at the interface between the bond portion 12 and the overlapping portion 20/21, a perf portion 27 parallel to and slightly spaced from the perf 26, perf sections 28 and 29 which define between them a strip 31, perf sections 33 and 35 which define between them a strip 37, and a tractor portion 38, exterior of the perf 35 and having tractor holes 39 therein. The second side edge 19 of the bond portion 12 overlaps the label stock 11, while the first side edge 40 has the tractor openings 39 adjacent thereto.

As seen in FIG. 1, a panel 30 of the bond portion 12 of the form 10, which preferably serves as a first invoice copy, is defined between the perf sections 27 and 28, while another section 34 of the bond portion 12, which preferably serves as the shipping label (having variable address information printed thereon) is disposed between the perf sections 29, 33. A second invoice copy is preferably printed on the paper forming the major face 14 of the label stock.

As seen in FIG. 2, a section of the form on the opposite side thereof as the section 30 is the section 42, which may have press, pre-printed information thereon, printed at a first manufacturing location. On the opposite side of the form as the shipping label section 34 is another press, pre-printed information section 44. Adjacent the first edge 40 of the bond portion 12 is another adhesive strip 46, which may be hot melt reheatable or pressure seal adhesive, or the like. This adhesive strip 46 acts with the adhesive strip 23 (or 24) to hold the form together in a Z-folded configuration.

Figure 3:
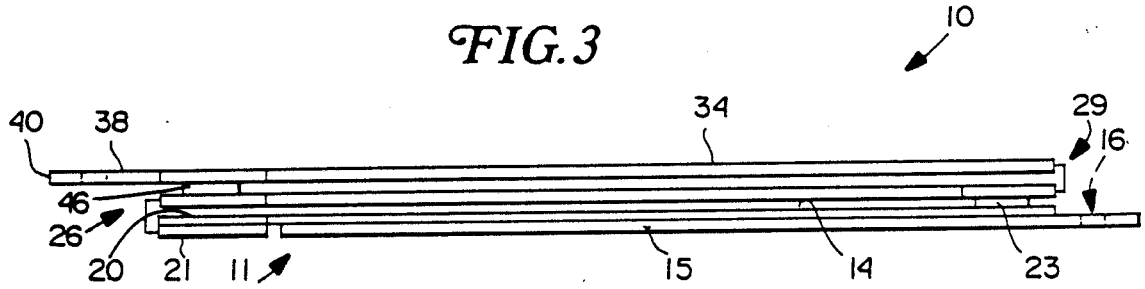
FIG. 3 is a side view showing the form of FIG. 1 when Z-folded.
Figure 4:
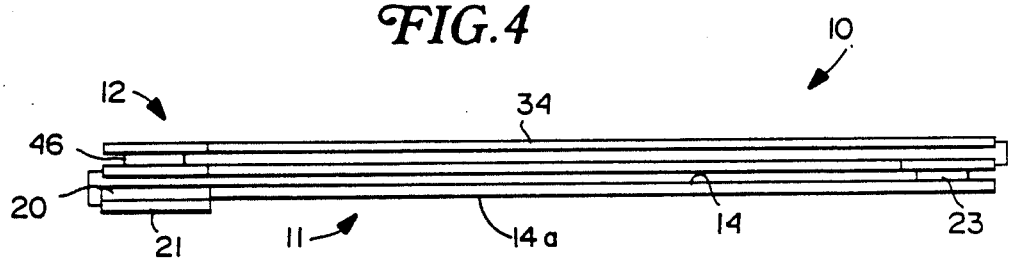
FIG. 4 is a view like FIG. 3 only showing the release paper for the label stock and the tractor drive portions removed.
Figure 5:
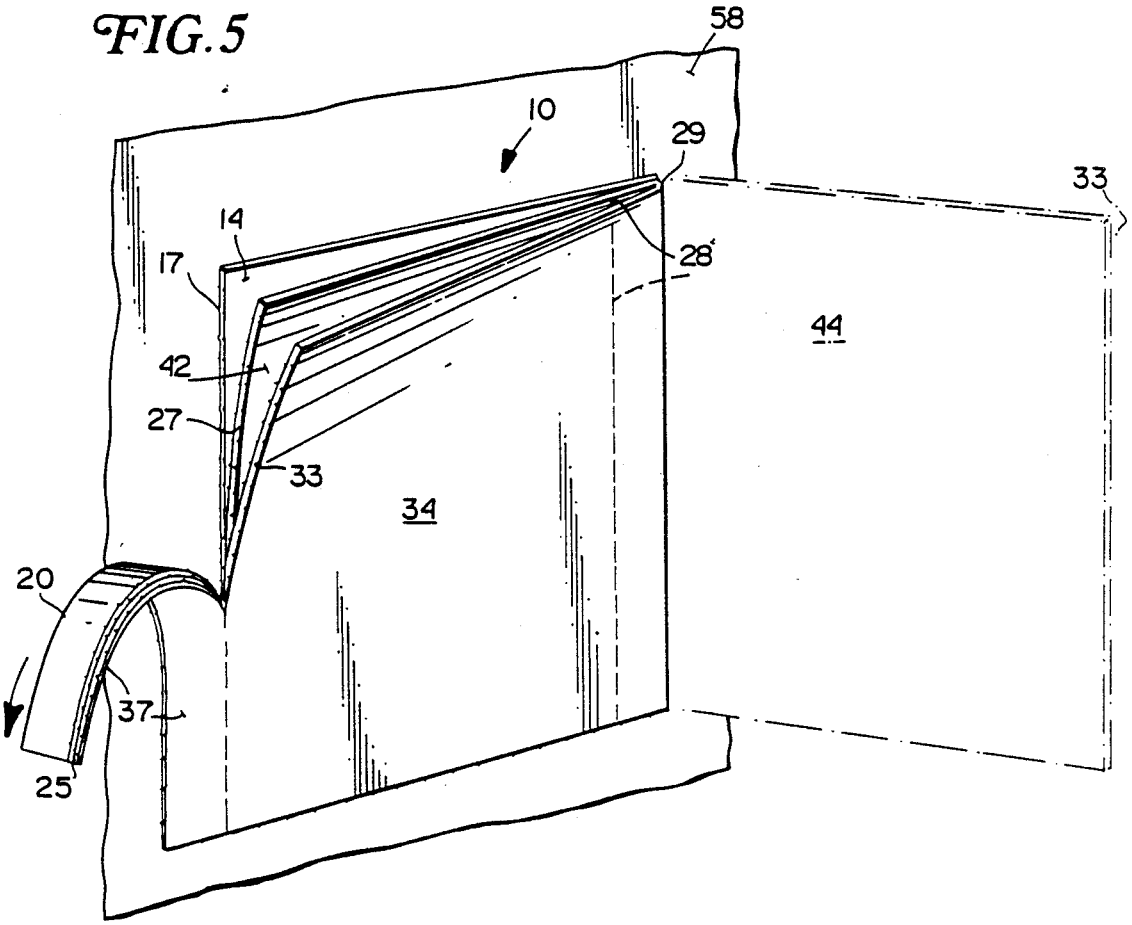
FIG. 5 is a perspective showing of the form of FIG. 4 in place on a package, and showing the ultimate consumer acting on the form so as to view the invoice portions thereof.

FIG. 3 illustrates the form 10 when it has been Z-folded about the perf lines 26 and 29. FIG. 4 illustrates the same form after the release paper 15 on the back of the label stock has been removed, along with tractor feed section 38 adjacent the first edge 40 of the bond section 12. Once the form 10 has been folded in that manner, and the release strips 24 and 46 have been removed, the form is held together in the Z-fold configuration, then the label stock 14 is pressed onto a package 58 or the like, so that the form 10 forms a packing slip-/invoice assembly as illustrated in FIG. 5. FIG. 5 illustrates the form 10 as the ultimate consumer is removing the strips 20, 25, 37 to allow access to the interior of the form, so that the form folds outwardly about perforations 29 and 27. Portions 34/44 and 30/42 may be detached in this condition merely by separating them at perforations 28 and 29.

Figure 6:
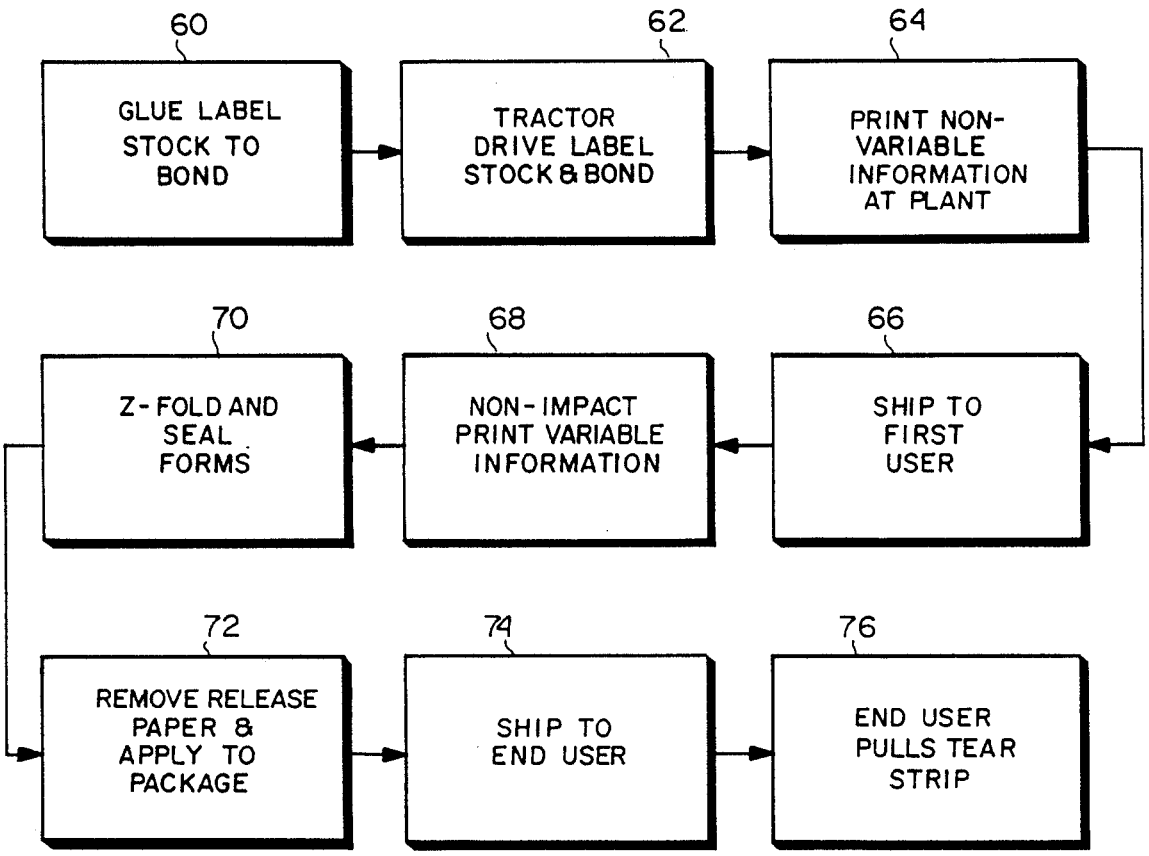
FIG. 6 is a schematic view showing the step-by-step practice of a method pursuant to the invention.

FIG. 6 illustrates the step-by-step manner of constructing the form according to the invention. At stage 60, the label stock 11 is glued at the overlapping portion 20/21 to the bond stock 12, a continuous strip being formed (that is portions connected to the top and bottom edges 52, 54 also being provided) to provide a continuous business form. Detachment at edges 52, 54 occurs when desired after all printing has been completed, usually between stations 70 and 72. Using the tractor drive holes 16, 39 (see box 62) the form 10 is printed with non-variable information at stage 64. The printing at a plant at a first location is optional. This printing with non-variable information step is practiced at a high-speed printing facility utilizing printing presses, the printing taking place on sections 42, 44. Then the form 10—which is still continuous in nature—is shipped at stage 66 to the first user, who will print the variable information thereon. At stage 68 the first user passes the form through his own printing equipment, again preferably utilizing tractor holes 16, 39 and then variable information is printed on sections 30, 34 and the top surface 14 of the label stock 11. Typically, the first invoice copy would be printed on section 30, the second invoice could copy on section 14 and the shipping label—which includes the variable address information—on section 34. Printing at the first user's location, remote from the station 64, can be done by a non-impact printer, such as a cold fuse, laser, or LED printer.

After all of the information is printed on form 10, the form is separated into individual forms 10 along lines 52, 54, and is Z-folded, or is continuously Z-folded then detached. The Z-folded form looks as illustrated in FIG. 3. The forms are fed into a conventional sealing device, either heat or pressure sealed, and the various sections of the form are sealed to each other as illustrated in FIG. 3, by activating strips 23 (or 24) and 46.

The form of FIG. 3 is then—as indicated at station 72—acted upon so that the release paper 15 is removed from the label stock, removing the tractor portion 16 with it and also the tractor portion 38—if present—is removed. Then the adhesive on the back of the label stock 11 is pressed onto the package 58. As indicated at station 74, the package 58 is shipped to the end user. The end user, at station 76, grasps the tear strip 20/25/37, and separates the form along perfs 27, 33, 17. The sections 34, 42 can then be folded outwardly about the perfs 29, 28 and can be detached along those perfs so that the shipping label and first invoice copy are available to the end user.

In combination with the package, the packing list/invoice 10 according to the invention includes a first section including the face 30, a second section 42, and a third section 34 having address information or the like thereon.

It will thus be seen that according to the present invention, an advantageous business form and method of production and utilization thereof has been provided which allow for the simple application of variable information using a non-impact printer by a business forms manufacturer's customer, and allow the production of a simple and easy to use packing list/invoice. While the invention has been herein shown and described in what is presently conceived to be the most practical and preferred embodiment thereof, it will be apparent to those of ordinary skill in the art that many modifications may be made thereof within the scope of the invention which scope is to be accorded the broadest interpretation of the appended claims so as to encompass all equivalent products and procedures.

WHAT IS CLAIMED IS:

1. A business form suitable for use as a packing list or invoice attached to a package, and having a portion thereof serving as a shipping label to which variable address information may be applied, comprising:

a label stock portion having first and second side edges and first and second major faces;

a bond paper portion having first and second side edges and first and second major faces;

the second edge of said label stock portion being overlapped with the second edge of the bond paper portion and fixed together at the overlapped portion;

means defining tractor holes adjacent said label stock portion first edge and adjacent said bond stock portion first edge, for facilitating feeding of said form through printers; and said second face of said label stock essentially completely covered by adhesive.

2. A business form as recited in claim 1 wherein said label stock comprises a release paper portion overlying said second major face, and wherein said means defining tractor holes defines holes in said release paper portion; and said label stock further comprises means facilitating separation of a portion of said bond paper portion having said means defining tractor holes therein from the rest of said bond paper portion:

3. A business form as recited in claim 1 wherein said label stock portion of the first major face has invoice indicia printed thereon, and wherein said bond paper portion first major face has invoice information and variable shipping information printed thereon; and wherein said bond paper portion second major face has non-variable information printed thereon.

4. As form as recited in claim 1 further comprising perforations extending parallel to the side edges of said bond stock at spaced locations thereof to partition said bond stock into distinct portions, and to facilitate accordion folding thereof.

5. A business form as recited in claim 4 wherein one of said perforations is provided adjacent the overlapping portion of said label stock and bond paper portions.

6. A business form as recited in claim 4 wherein said perforations are positioned so as to facilitate Z-folding of said business form so that it has a top layer, a middle layer, and a bottom layer formed by said label stock.

7. A business form suitable for use as a packing list or invoice attached to a package, and having a portion thereof serving as a shipping label to which variable address information may be applied, comprising:

a label stock portion having first and second side edges and first and second major faces;

a bond paper portion having first and second side edges and first and second major faces;

the second edge of said label stock portion being overlapped with the second edge of the bond paper portion and fixed together at the overlapped portion;

an adhesive strip applied to said first face of said label stock adjacent said first edge;

said second face of said label stock essentially completely covered by adhesive; and an adhesive strip applied to said bond portion second face adjacent said first edge thereof.

8. A business form as recited in claim 7 wherein said label stock portion of the first major face has invoice indicia printed thereon, and wherein said bond paper portion first major face has invoice information and variable shipping information printed thereon; and wherein said bond paper portion second major face has non-variable information printed thereon.

9. A form as recited in claim 7 further comprising perforations extending parallel to the side edges of said bond stock at spaced locations thereof to partition said bond stock into distinct portions, and to facilitate accordion folding thereof.

10. A business form as recited in claim 9 wherein said perforations are positioned so as to facilitate Z-folding of said business form so that it has a top layer, a middle layer, and a bottom layer formed by said label stock.

11. A business form as recited in claim 7 further comprising means defining tractor holes adjacent said label stock portion first edge and adjacent said bond stock portion first edge, for facilitating feeding of said form through printers.

12. A business form as recited in claim 11 wherein said label stock comprises a release paper portion overlying said second major face, and wherein said means defining tractor holes defines holes in said release paper portion; and said label stock further comprises means facilitating separation of a portion of said bond paper portion having said means defining tractor holes therein from the rest of said bond paper portion.

13. In combination with a package, a packing list/invoice, comprising:

a first section having a first face with invoice information thereon and a second face with adhesive thereon connecting said first section to said package;

a second section overlying said first section;

a third section overlying said second section, said third section having address information on the face thereof opposite said package;

said first, second and third sections in a Z-folded position and having opposite generally aligned first and second edges;

removable means for removably operatively connecting said first, second and third sections together along the first edge thereof; and said first, second, and third sections also being operatively connected together at or adjacent the second edge thereof.

14. A combination as recited in claim 13 further comprising perforations between said first, second and third sections to allow ready detachment thereof.

* * * * *